US005137385A

United States Patent [19]

Kamimura et al.

[11] Patent Number: 5,137,385

[45] Date of Patent: Aug. 11, 1992

[54] PRINTER FOR USE WITH ELECTRONIC CASH REGISTER

[75] Inventors: Masahiro Kamimura; Akehiro Ono, both of Nagoya, Japan

[73] Assignee: Brother Kyogo Kabushiki Kaisha, Nagoya, Japan

[21] Appl. No.: 825,311

[22] Filed: Jan. 27, 1992

Related U.S. Application Data

[63] Continuation of Ser. No. 523,421, May 15, 1990, abandoned.

[30] Foreign Application Priority Data

May 15, 1989 [JP] Japan ..... 1-120757

[51] Int. Cl.[5] ..... B41J 29/13

[52] U.S. Cl. ..... 400/690.4; 400/692; 400/691; 400/690

[58] Field of Search ..... 400/689, 690, 690.1, 400/690.4, 691, 692, 693, 693.1, 694, 208

[56] References Cited

U.S. PATENT DOCUMENTS

| | | | |
|---|---|---|---|
| 3,180,572 | 4/1965 | Gallant | 400/693 |
| 4,119,385 | 10/1978 | Watanabe | 400/693.1 |
| 4,531,852 | 7/1985 | Madge et al. | 400/692 |
| 4,828,417 | 5/1989 | Tano et al. | 400/693 |
| 4,961,659 | 10/1990 | Igarashi | 400/693 |

FOREIGN PATENT DOCUMENTS

| | | | |
|---|---|---|---|
| 189124 | 7/1986 | European Pat. Off. | 400/693 |
| 78774 | 5/1985 | Japan | 400/208 |
| 245574 | 12/1985 | Japan | 400/208 |
| 80070 | 4/1987 | Japan | 400/693 |
| 199669 | 8/1988 | Japan | 400/692 |

*Primary Examiner*—Edgar S. Burr
*Assistant Examiner*—Joseph R. Keating
*Attorney, Agent, or Firm*—Oliff & Berridge

[57] ABSTRACT

A printer for use with an electronic cash register in which both a printer mechanism and an openable/closable unit are housed in a cabinet. A cover member is openably and closeably mounted on the cabinet for lying over the unit. A rib is provided in the rear surface of the cover member, and an abutment block is provided in the openable/closable unit. The rib is brought to abutment with the block when the cover member is closed, while the abutment block is brought to abutment with the rib when the openable/closable unit is moved from the closed position to the open position. The cover is openable in accordance with the opening movement of the openable/closable unit through abutment of the rib and block whereas it is closable in accordance with the closing movement of the cover member through the abutment thereof.

14 Claims, 7 Drawing Sheets

PRINTER FOR USE WITH ELECTRONIC CASH REGISTER

This is a continuation of application Ser. No. 07/523,421 filed May 15, 1990, now abandoned.

BACKGROUND OF THE INVENTION

The present invention relates to a printer, and more particularly to a printer for use with an electronic cash register.

Printers of the type mentioned above are disclosed in copending U.S. patent application Ser. No. 07/321,287 filed Mar. 9, 1989.

The printer proposed in the earlier application comprises a printer mechanism composed primarily of a print head, an openable/closable unit angularly movably mounted on the printer mechanism and movable between a closed position and an open position, resilient means for normally urging the openable/closable unit toward the open position, and a lock mechanism for holding the openable/closable unit in the closed position against the bias of the resilient means.

When the printer is sold as a product, it is accommodated in a protective case which is primarily used to protect the printer mechanism. Generally, the protective case comprises a cover member for covering the openable/closable unit. The cover member is openably and closably mounted for angular movement on a cabinet surrounding the printer mechanism and the openable/closable unit, for easy maintenance such that a receipt sheet and a journal sheet can easily be replaced and stamp can be replaced if it is used.

When a sheet is to be replaced in the printer with the protective case, it is necessary to open the cover member; release the lock mechanism and open the openable/closable unit; replace the sheet; return the openable/closable unit to the closed position after roll sheet or the like has been replaced; and close the cover member.

Since the cover member and the openable/closable unit are required to be opened and closed independently, the sheet replacement has been laborious and tedious for the operator. With the above printer, while the openable/closable unit can be opened to facilitate sheet replacement, the protective case has not been designed from the standpoint of sheet replacement.

SUMMARY OF THE INVENTION

The present invention has been devised in an effort to solve the above problems. It is therefore an object of the present invention to provide a printer having an openable/closable unit which can be opened for sheet replacement, wherein the opening and closing capability of the openable/closable unit is effectively utilized to eliminate any complex process which the operator would have to follow in replacing a sheet, for better sheet replacement.

To achieve the above and other objects, there is provided a printer comprising a printer mechanism including a printer head, an openable/closable unit angularly movably mounted on the printer mechanism and movable between a closed position in which a sheet passage is defined between the printer mechanism and the openable/closable unit and an open position in which sheets can be replaced, resilient means for normally urging the openable/closable unit toward the open position, a lock mechanism for holding the openable/closable unit in the closed position against the urging of the resilient means, a cabinet defined by front, rear and two side panels and housing therein both the printer mechanism and the openable/closable unit, a cover member openably and closably mounted on the cabinet for covering the openable/closable unit, abutment means disposed between the openable/closable unit and the cover member for abutment against both the openable/closable unit and the cover member, and an unlock member coupled to the locking mechanism for bringing the openable/closable unit from the closed position to the open position, the cover member being openable in accordance with an opening movement of the openable/closable unit through the abutment means and the openable/closable unit being closable in accordance with a closing movement of the cover member through the abutment means.

With the present invention thus arranged, when the cover member is to be opened, the unlocked member is operated to unlock the openable/closable unit from the lock mechanism. As the openable/closable unit is turned to the open position under the bias of the resilient means, the cover member is also opened through the abutment means.

When the cover member is closed, the openable/closable unit is turned to the closed position against the bias of the resilient means through the abutment means. At the same time that the cover member is completely closed, the openable/closable unit is locked in the closed position by the lock mechanism.

The above and other objects, features and advantages of the present invention will become more apparent from the following description when taken in conjunction with the accompanying drawings in which a preferred embodiment is shown by way of illustrative example.

DETAILED DESCRIPTION OF THE PREFERRED EMBODIMENTS

An embodiment of the present invention will hereinafter be described with reference to the drawings. The principal structure of the printer of the embodiment is disclosed in copending U.S. patent application Ser. No. 07/321,287.

Figure 1:
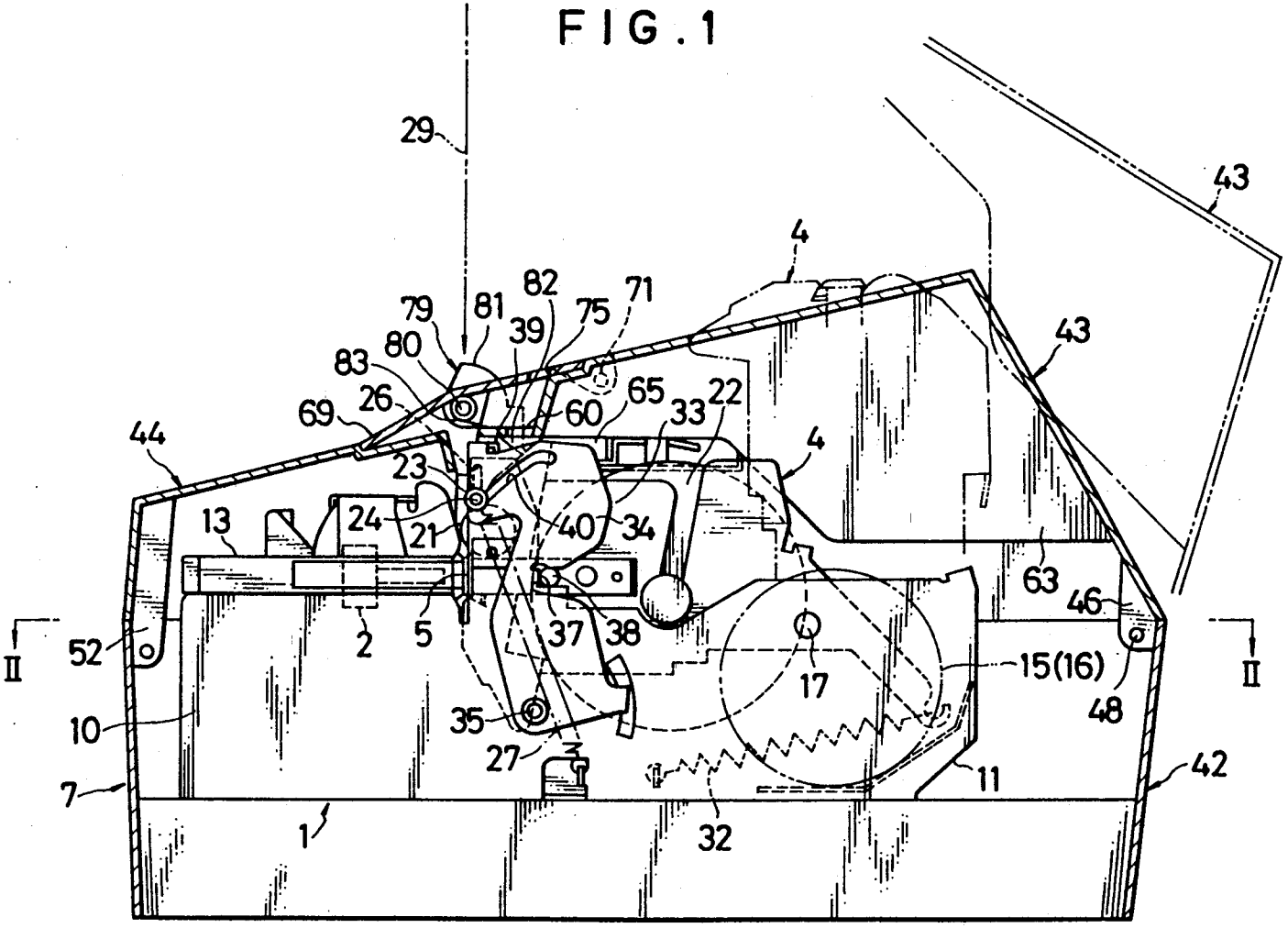
FIG. 1 is a sectional side elevational view showing a printer.
Figure 2:
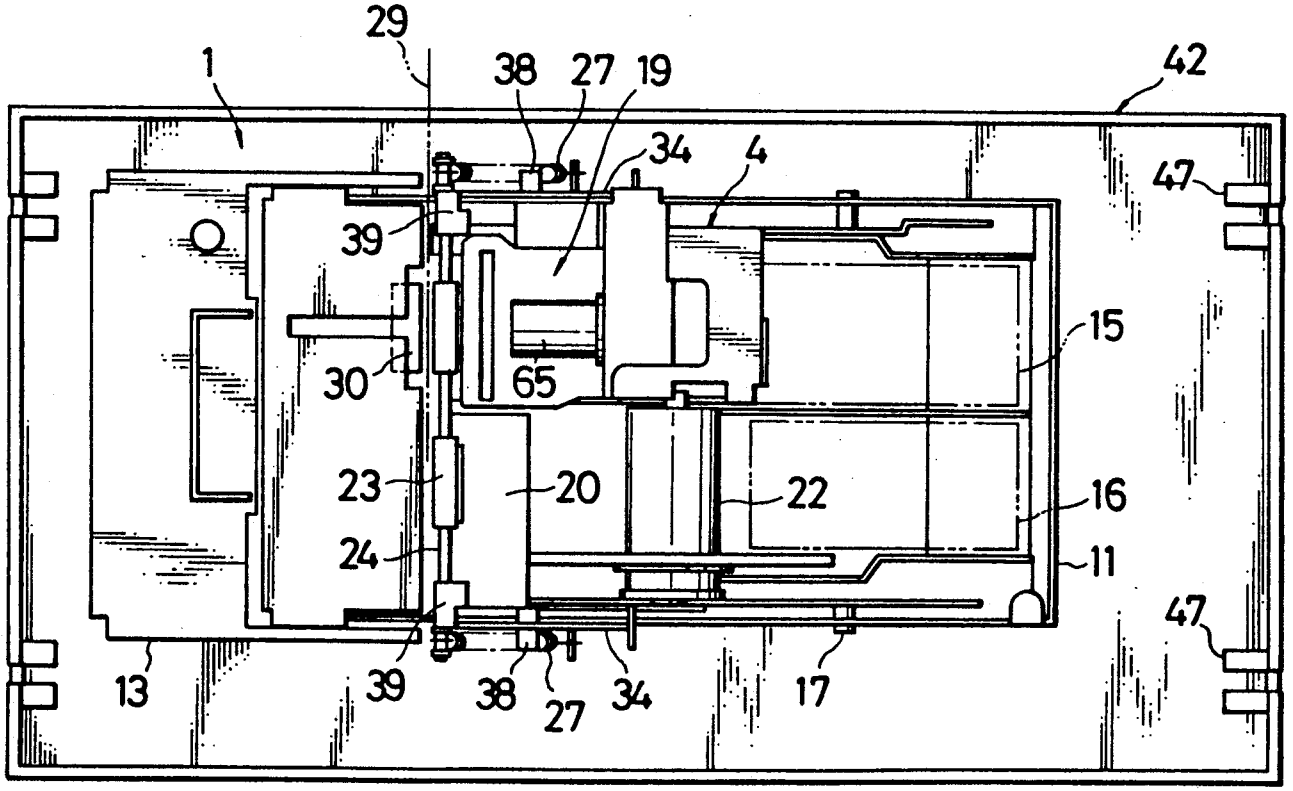
FIG. 2 is a cross-sectional view taken along line II—II of FIG. 1.

FIG. 1 is a sectional side elevational view of the printer, and FIG. 2 is a cross-sectional view taken along line II—II of FIG. 1. In FIGS. 1 and 2, the printer comprises a printer mechanism 1 composed primarily of a print head 2 and an openable/closable unit 4 having a platen 5 and a sheet feed mechanism The printer mechanism 1 and the openable/closable unit 4 are housed in a protective case 7. The printer mechanism 1 has a frame 10 and a paper holder 11 mounted on a rear lower portion of the frame 10. The frame 10 accommodates therein the print head 2 and printing components associated with the print head 2. The printing components include a carriage on which the print head 2 is mounted, a moving mechanism for reciprocally moving the carriage, and a drive motor for driving the moving mechanism. An ink ribbon cartridge 13 is replaceably set on the frame 10.

The paper holder 11 is in the form of an upwardly open box. A receipt sheet 15 and a journal sheet 16, each in the form of a sheet roll, are disposed in juxtaposed relation in the paper holder 11. The sheets 15, 16 can be unrolled clockwise in FIG. 1.

Figure 3:
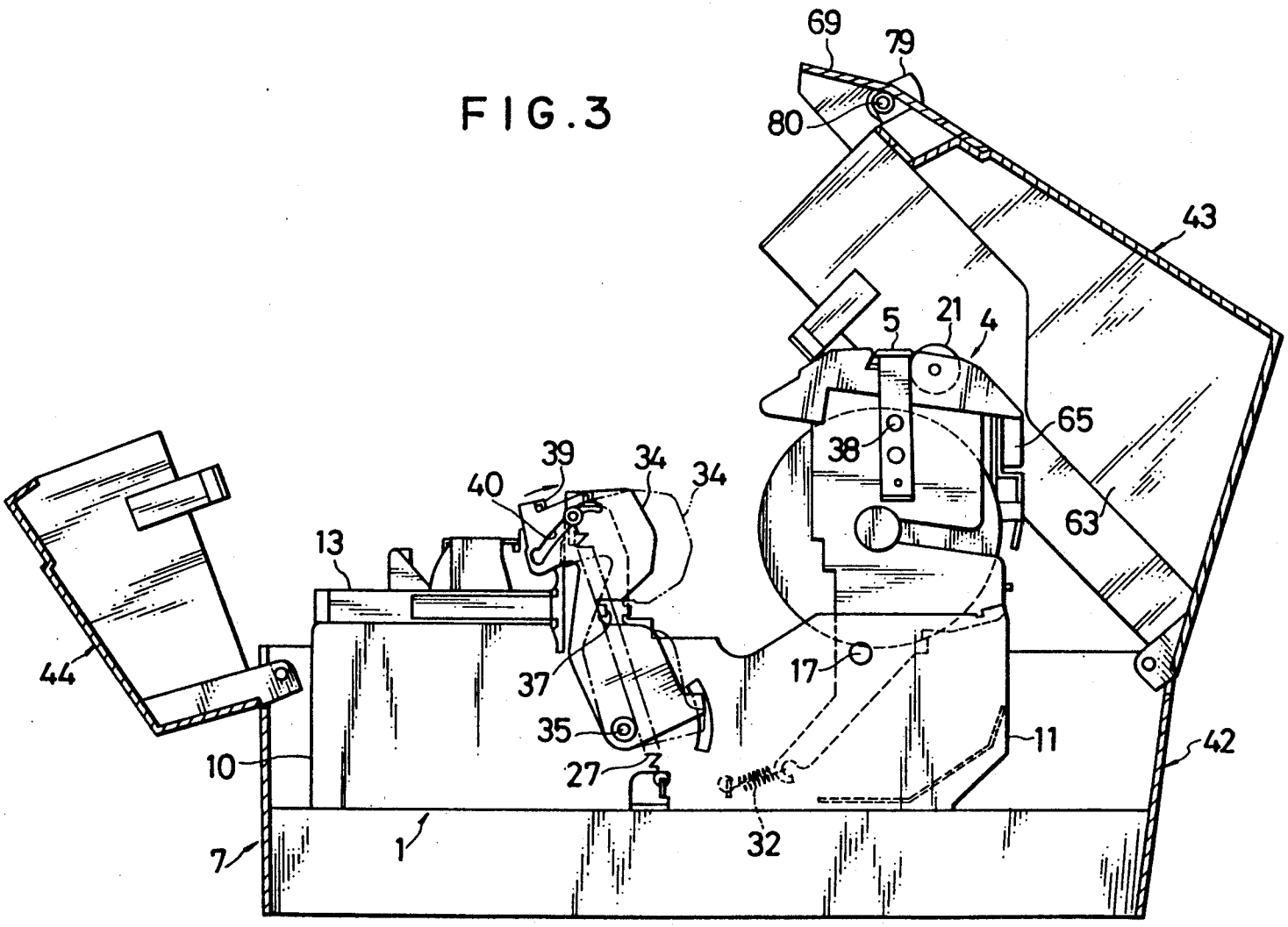
FIG. 3 is a sectional side elevational view showing an open condition of the printer.

The printer mechanism 1 has side walls near the paper holder 11, and the openable/closable unit 4 has side panels which are angularly movably supported on the side walls by support shaft 17. The openable/closable unit 4 is angularly movable between a closed position (indicated by the solid lines in FIG. 1) in which a sheet passage is defined between the printer mechanism 1 and itself and an open position (indicated by the two-dotted-and-dash lines in FIG. 1) in which the sheets can be replaced. The openable/closable unit 4 in the open position is shown in FIG. 3.

As shown in FIGS. 1 and 2, the platen 5 on the openable/closable unit 4 is disposed in confronting relationship to the print head 2 in the closed position. The sheet feed mechanism on the openable/closable unit 4 feeds the sheets 15, 16. The openable/closable unit 4 also has, in addition to the platen 5 and the sheet feed mechanism, a cutter mechanism 19 for cutting off the leading end of the receipt sheet 15, and a writing table 20 for the journal sheet 16. The sheet feed mechanism comprises a feed roller 21 disposed upwardly of and adjacent to the platen 5, a takeup roll 22 for winding the journal sheet 16, a drive mechanism for driving the feed roller 21 and the takeup roll 22, and a drive motor for actuating the drive mechanism.

Presser rollers 23 disposed above and confronting the feed roller 21 are supported on a roller shaft 24 which is rotatably and vertically movably supported in vertically elongated guide slots 26 defined in the side walls of the frame 10. Between the roller shaft 24 and the bottom of the frame 10, there are coupled springs 27 for pressing the presser rollers 23 against the feed roller 21. The sheets 15, 16 are sandwiched between the presser rollers 23 and the feed roller 21, and fed by the feed roller 21 as it is driven.

A slit for insertion therethrough of a cut sheet 29 such as a validation sheet, a slip sheet, or the like is defined between the printer mechanism 1 and the openable/closable unit 4. An auxiliary roller 30 which is movable toward the feed roller 21 in response to insertion of the cut sheet 29, for pressing the cut sheet 29 against the feed roller 21 is reciprocally movably mounted on the printer mechanism 1 by a reciprocally moving means (not shown).

A resilient means 32 comprising a coil spring is coupled between a side panel of the openable/closable unit 4 and the paper holder 11. The resilient means 32 serves to normally urge the openable/closable unit 4 under its own resiliency in a direction to turn the unit 4 toward the open position.

The printer mechanism 1 has a lock mechanism 33 for holding the openable/closable unit 4 in the closed position against the bias of the resilient means 32. The lock mechanism 33 mainly comprises two laterally spaced lock levers 34 mounted symmetrically on the respective side walls of the frame 10 and having lower ends angularly movable about support pins 35. The lock levers 34 have respective locking recesses 37 which receive lock pins 38 projecting from the side walls of the openable/closable unit 4, for holding the unit 4 in the closed position against the bias of the resilient means 32.

The lock levers 34 have respective operating members 39 on their upper ends and also cam slots 40 inclined progressively upwardly in the rearward direction. The roller shaft 24 on which the presser roller 23 are mounted slidably rides in the cam slots 40. In the closed position of the openable/closable unit 4, the roller shaft 24 is positioned in the lower ends of the guide slots 26 and the cam slots 40 under the resiliency of the spring 27. When the lock levers 34 are turned counterclockwise in FIG. 1 about the support pins 35 in response to forwardly pushed movement of the operating members 39, the roller shaft 24 is moved upwardly along the guide slots 26 while being guided by the cam slots 40 against the bias of the spring 27, whereupon the presser rollers 23 are retracted upwardly of the feed roller 21 and, at the same time, the lock pins 38 of the openable/closable unit 4 are released from the locking recesses 37 (see the solid-line position in FIG. 3). When the operating members 39 are released, the presser rollers 23 are lowered under the resiliency of the spring 27, causing the lock levers 34 to return to their original position (see the two-dot-and-dash-line position in FIG. 3). The spring 27 serves not only to urge the presser rollers 23 but also to bias the lock levers 34 toward their original position.

The protective case 7 in which the printer mechanism 1 and the openable/closable unit 4 are housed will now be described below.

Figure 4:
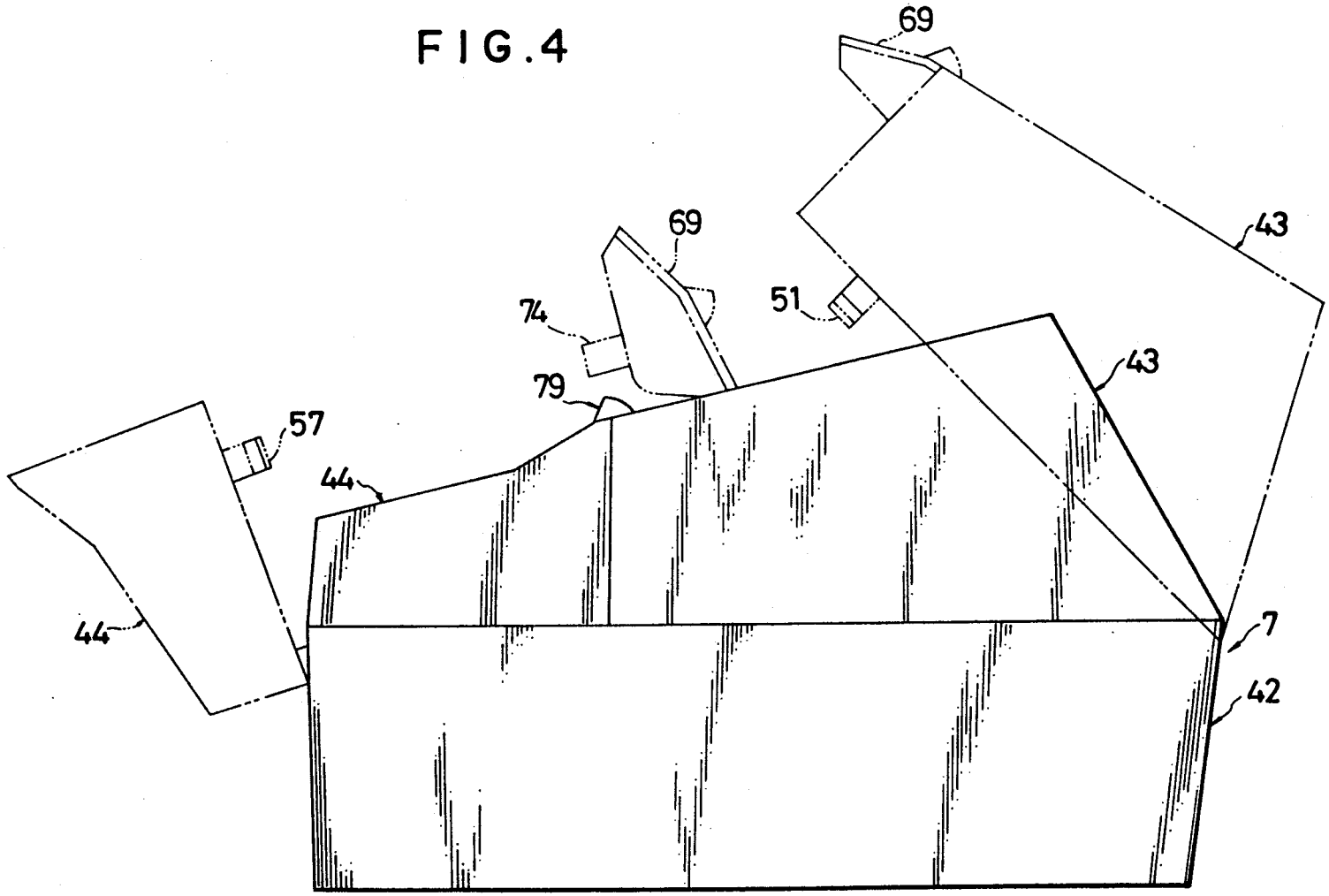
FIG. 4 is a side elevational view showing a protective case.
Figure 5:
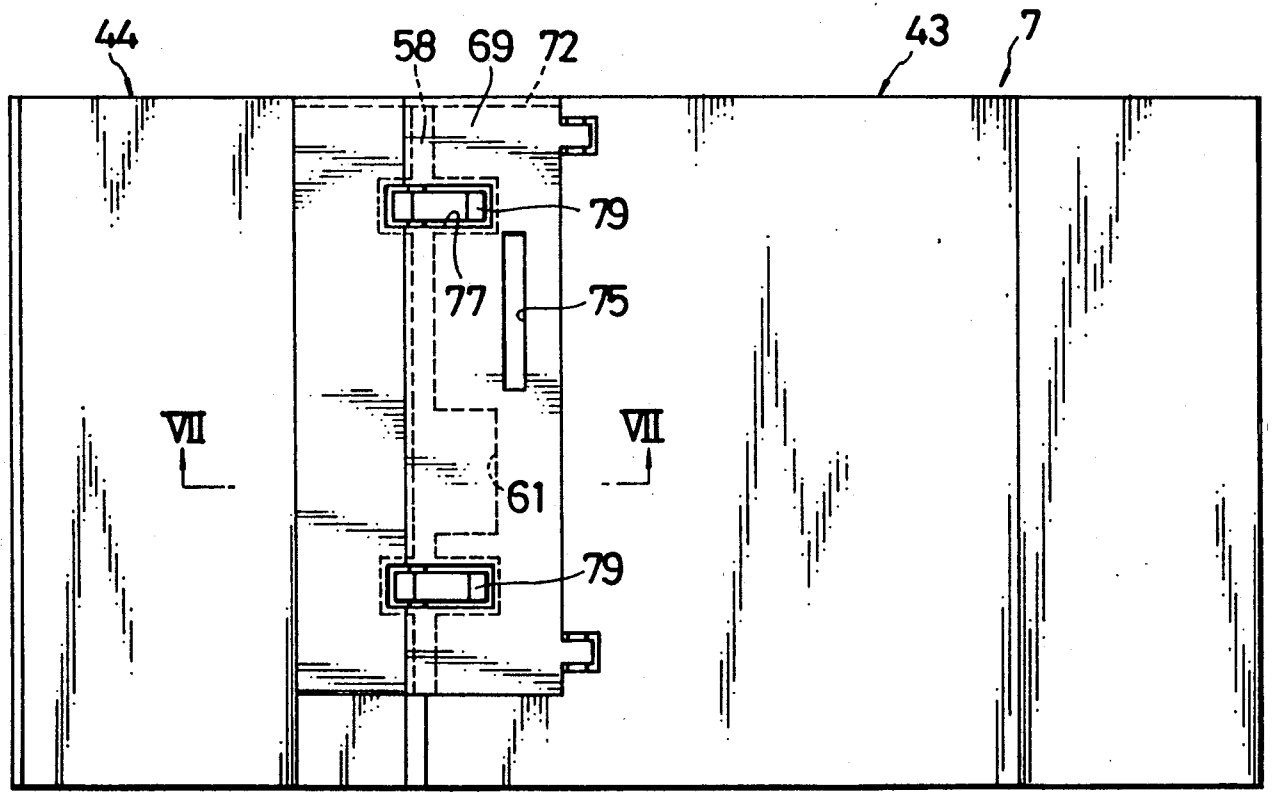
FIG. 5 is a plan view showing the protective case.
Figure 6:
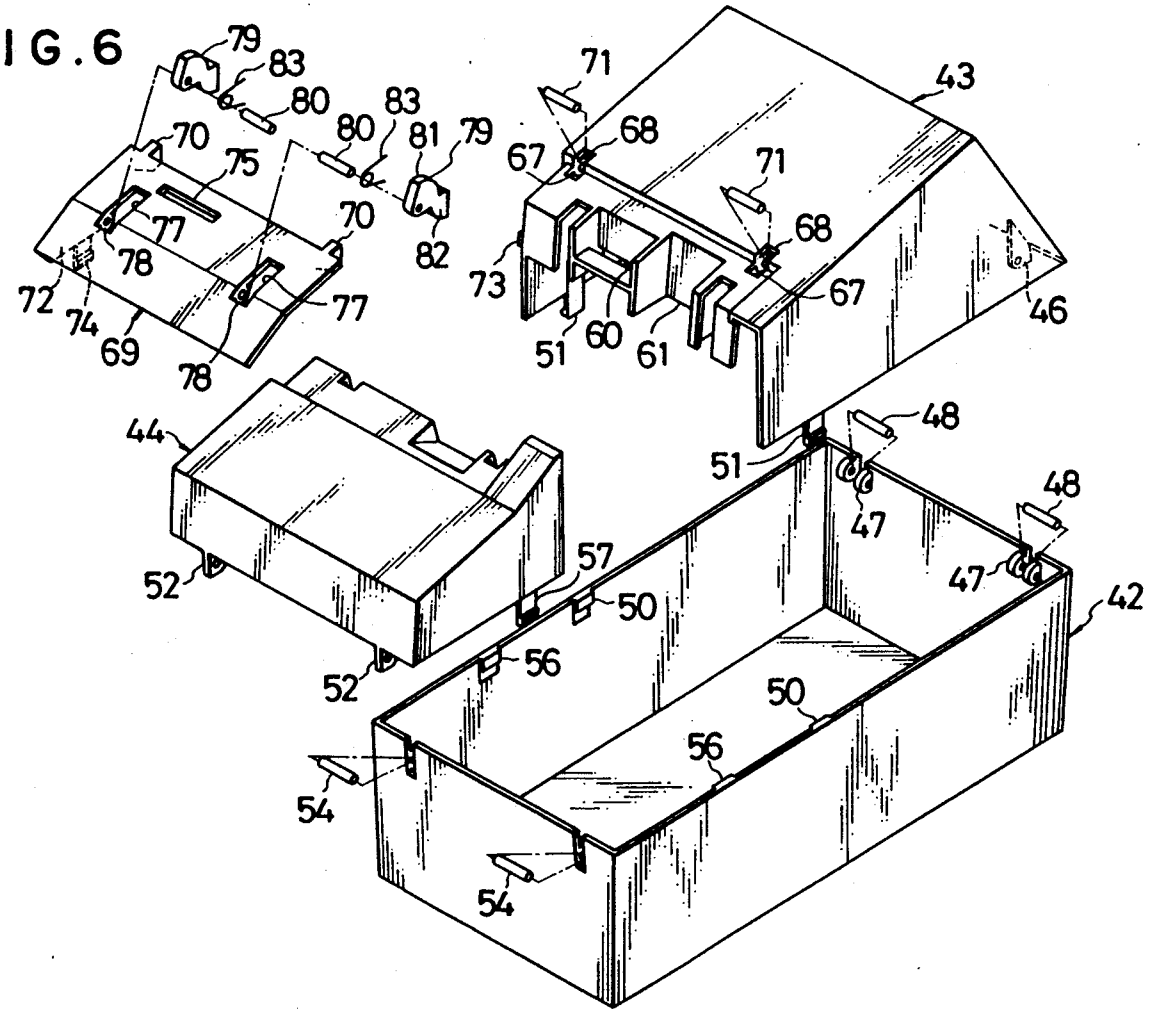
FIG. 6 is an exploded perspective view showing the protective case.

FIG. 4 is a side elevational view of the protective case 7, FIG. 5 is a plan view thereof, and FIG. 6 is an exploded perspective view thereof. As shown in FIGS. 1, 4, 5 and 6, the protective case 7 is in the form of an upwardly open box, and comprises a cabinet 42 surrounding the printer mechanism 1 and the openable/closable unit 4, a cover member 43 lying over an upper portion of the openable/closable unit 4, and an auxiliary cover member 44 lying over the ink ribbon cartridge 13 on the printer mechanism 1. The cabinet 42, the cover member 43, and the auxiliary cover member 44 are made of a synthetic resin material.

As shown in FIGS. 1 and 6, the cover member 43 has two laterally spaced attachment members 46 on its rear end which are angularly movably attached by shafts 48 to bearings 47 on a rear panel of the cabinet 42. Thus, the cover member 43 is openably and closably mounted for angular movement on the cabinet 42. The cover member 43 has snap legs 51 on two laterally spaced side panels thereof, the snap legs 51 being engageable, under their own spreading resiliency, with respective ledges 50 projecting inwardly from the upper edges of the side panels of the cabinet 42.

The auxiliary cover member 44 has two laterally spaced attachment members 52 on its front end which are angularly movably mounted by shafts 54 on bearings (with no reference numerals) on the front panel of the cabinet 42. The auxiliary cover member 44 has snap legs 57 on two laterally spaced side panels thereof, the snap legs 57 being engageable, under their own spreading resiliency, with respective ledges 56 projecting inwardly from the upper edges of the side panels of the cabinet 42. The confronting end surfaces of the auxiliary cover member 44 and the cover member 43 define therebetween a slit 58 (see FIG. 5 and FIG. 7 which is a cross-sectional view taken along line VII—VII of FIG. 5) for insertion therethrough of a cut sheet 29 between the openable/closable unit 4 and the frame 10.

Figure 7:
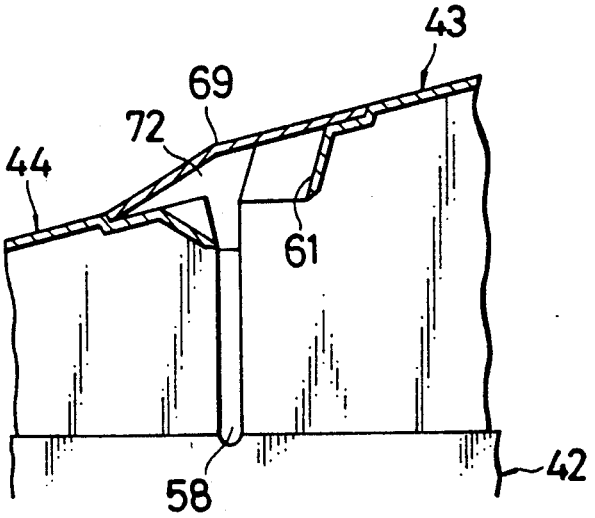
FIG. 7 is a cross-sectional view taken along line VII—VII of FIG. 5.

The upper panel of the cover member 43 has an outlet slot 60 for the receipt sheet 15 and a recess 61 for allowing a message or the like to be written on the journal sheet 16 over the writing table 20 of the openable/closable unit 4 (see FIGS. 1, 6 and 7).

As illustrated in FIGS. 1, 2 and 3, a rib 63 extending in the longitudinal direction is disposed on the reverse side (lower side) of the upper panel of the cover member 43. The rib 63 is engageable with an abutment block 65 on the upper surface of the cutter mechanism 19 of the openable/closable unit 4. The rib 63 and the abutment block 65 serve as the abutment means of the present invention.

As shown in FIG. 6, two laterally spaced attachment holes 67 and two laterally spaced bearings 68 are defined in a front portion of the upper panel of the cover member 43. The front end and front portion of the cover member 43 are covered by a clear cover 69 of synthetic resin. The clear cover 69 has two laterally spaced attachment members 70 on its rear end which are disposed in the attachment holes 67, respectively, and openably and closably mounted for angular movement on the bearings 68, respectively, through a shaft 71 (see FIG. 1). The clear cover 69 serves as part of the cover member 43.

As shown in FIGS. 5 and 6, the clear cover 69 has a side panel 72 on its left end. The side panel 72 has a snap leg 74 which is engageable, under its own resiliency, with a ledge 73 projecting outwardly from the upper edge of one of the side panel of the cover member 43.

The clear cover 69 has an outlet slot 75 defined therein in alignment with the outlet slot 60 in the cover member 43. The end of the receipt sheet 15 which is fed out by the feed roller 21 and the presser roller 23 is threaded through the outlet slots 60, 75. As shown in FIG. 1, a space for allowing the sheet 15 to become loose is defined in the vicinity of the outlet slots 60, 75 in the clear cover 69 and the cover member 43, so that a paper jam will not occur when the end of the receipt sheet 15 is held down by hand. The clear cover 69 has its front end hanging over the auxiliary cover member 44 for preventing coins, pins, etc. from dropping into the slit 58 and the recess 61, thereby to protect the printer mechanism from failures.

The clear cover 69 has two laterally spaced openings 77 defined therein respectively above the operating member 39 of the lock levers 34 (see FIGS. 1, 5 and 6). The clear cover 69 also has bearings 78 disposed adjacent to the respective opening 77, and unlock levers 79 are angularly movably supported on the respective bearings 78 through shafts 80.

The unlock levers 79 have respective operating portions 81 projecting through the openings 77 above the clear cover 59, and acting portions 82 disposed behind the operating members 39 of the lock levers 34. The unlock levers 79 are normally urged into a standby position (see the solid-line position in FIG. 1) under the bias of springs 83 coiled around the shafts 80, respectively. When the operating members 81 of the unlock levers 79 are pushed rearwardly against the resiliency of the springs 83, the acting portions 82 turn the lock levers 34 for lifting the presser roller 23 against the bias of the springs 27, whereupon the openable/closable unit 4 is unlocked (see FIG. 3).

When the openable/closable unit 4 and the cover member 43 are to be opened for replacing the sheets 15, 16 during use of the printer as shown in FIGS. 1 and 4, the operating portions 81 of the unlock levers 79 are pushed by the thumbs to turn the lock levers 34 for unlocking the openable/closable unit 4. At the same time, the side panels of the cover member 43 are pushed by index fingers or middle fingers until the snap legs 51 disengage from the ledges 50.

As the openable/closable unit 4 is turned toward the open position under the bias of the resilient means 32, the cover member 43 is also opened through the abutting engagement between the abutment block 65 and the rib 63 (see FIG. 3).

After the sheets 15, 16 are replaced, the cover member 43 is closed in order to close the openable/closable unit 4. As the cover member 43 is closed, the openable/closable unit 4 is turned toward the closed position through the abutting engagement between the abutment block 65 and the rib 63. Simultaneously with the complete closing of the openable/closable unit 4, the lock pins 38 of the openable/closable unit 4 engage into the locking slots 37 in the lock levers 34, whereupon the unit 4 is locked in the closed position.

Since the openable/closable unit 4 and the cover member 43 are opened and closed in interlinked relation, as described above, the sheet 15, 16 can be replaced with greater ease.

In order to open only the cover member 43 without opening the openable/closable unit 4, the unlock levers 79 are not operated on, but the snap legs 51 are disengaged from the legs 50 to open the cover member 43.

The clear cover 69 can be turned to the open position by disengaging the snap legs 74 from the ledges 73 (see the two-dot-dash lines in FIG. 4). With the clear cover 59 being thus open, the cut sheet 29 can be printed, and the operator can write a message as a check on the journal sheet 16 over the writing table 20.

After the clear cover 69 is opened, the snap legs 57 may be disengaged from the ledges 56 of the auxiliary cover member 44 and the auxiliary cover member 44 may be opened forwardly, whereupon the ink ribbon cartridge 13 may be replaced (see FIG. 3).

The present invention is not limited to the above embodiment, but various changes or modifications may be made without departing from the scope and spirit of the present invention. For example, while the unlock levers 79 are mounted on the clear cover 69 of the cover member 43, they may be mounted on the cover member 43 itself. The location of the feed sheet mechanism is not limited to the openable/closable unit 4, but it may be disposed in the printer mechanism 1.

In the aforesaid embodiment, the cover member 43 is opened under the bias of the resilient means 32. However, the resilient force of the resilient means 32 may be rendered smaller than the weight of the cover member 43, and the openable/closable unit 4 may be opened while the abutment block 65 is being held in abutment against the rib 63, under the bias of the resilient means 32 in response to a manual action to open the cover member 43.

With the present invention, as described in detail in a printer of the type in which an openable/closable unit is opened for sheet replacement, the openable/closable unit and a cover member can be opened and closed in interlinked relation. Therefore, the openable/closable unit and the cover member can be opened and closed easier than if they were opened and closed independently of each other. Sheet replacement allowed by the operation of the cover member which is required by sheet replacement, are facilitated to simplify the sheet replacing process.

What is claimed is:

1. A printer comprising:

a printer mechanism including a printer head;

an openable/closable unit angularly movably mounted on said printer mechanism and movable between a closed position in which a sheet passage is defined between said printer mechanism and said openable/closable unit and an open position in which sheets can be replaced;

resilient means for normally urging said openable/-closable unit toward the open position;

a locking means for holding said openable/closable unit in the closed position against the urging of said resilient means;

a lower based cabinet defined by front, rear and two side panels and housing fixedly therein said printer mechanism and enclosing said openable/closable unit when in the closed position;

a cover means openably and closably mounted on said cabinet for lying over said openable/closable unit;

abutment means attached to said openable/closable unit for contacting said cover means; and an unlock means coupled to said locking means for bringing said openable/closable unit from the closed position to the open position, said cover means being openable in accordance with an opening movement of said openable/closable unit through said abutment means and said openable/-closable unit being closable in accordance with a closing movement of said cover means through said abutment means, said cover means capable of being opened independent of said openable/closable unit.

2. A printer according to claim 1, wherein said printer mechanism further includes a frame, an ink ribbon cartridge replaceably set on said frame, and a paper holder in which at least one rolled sheet is disposed, and wherein said openable/closable unit includes a platen disposed in confronting relation to said print head for supporting the sheet thereon to be printed by said print head, and a sheet feeding means for feeding the sheet.

3. A printer according to claim 2, wherein said locking means comprises a lock lever angularly movably mounted on said frame, said lock lever having a locking recess, said openable/closable unit having a lock pin which engages the locking recess when said openable/-closable unit is held in the closed position.

4. A printer according to claim 3, wherein said unlock means is operatively coupled to said lock lever to angularly move said lock lever, and wherein said lock pin is disengaged from the locking recess when said unlock means is operated.

5. A printer according to claim 4, wherein said locking means further comprises a spring for normally urging said lock lever toward a position to engage said lock pin.

6. A printer according to claim 2, further comprising an auxiliary cover means lying over the ink ribbon cartridge, and wherein said cover means lies over an upper portion of said openable/closable unit when in the closed position.

7. A printer according to claim 6, wherein said auxiliary cover means has two laterally spaced attachment members which are angularly movably mounted on the front panel of said cabinet.

8. A printer according to claim 7, wherein said auxiliary cover means comprises two laterally spaced side panels, two snap legs provided thereon, said snap legs having spreading resiliency and being engageable with respective ledges projecting inwardly from upper edges of the side panels of said cabinet.

9. A printer according to claim 6, wherein said cover means comprises an upper panel, two laterally spaced side panels, two snap legs having spreading resiliency and being engageable with respective ledges projecting inwardly from upper edges of the side panels of said cabinet.

10. A printer according to claim 9, wherein said abutment means comprises a rib disposed on a reverse side of the upper panel of said cover means, and an abutment block provided in said openable/closable unit.

11. A printer according to claim 6, wherein said cover means includes a clear cover which has an end hanging over said auxiliary cover means.

12. A printer according to claim 11, wherein said clear cover is formed with at least one opening in which said unlock lever is disposed.

13. A printer according to claim 1, wherein said unlock means is disposed in a position accessible for an operator when said cover means is closed.

14. A printer comprising:

a printer mechanism including a printer head;

an openable/closable unit angularly movably mounted on said printer mechanism and movable between a closed position in which a sheet passage is defined between said printer mechanism and said openable/closable unit and an open position in which sheets can be replaced;

resilient means for normally urging said openable/-closable unit toward the open position;

a locking means for holding said openable/closable unit in the closed position against the urging of said resilient means;

a locking means for holding said openable/closable unit in the closed position against the urging of said resilient means;

a lower based cabinet defined by front, rear and two side panels and housing fixedly therein said printer mechanism and enclosing said openable/closable unit when in the closed position;

a cover means openably and closably mounted on said cabinet for lying over said openable/closable unit; said cover means having an opening therein;

abutment means attached to said openable/closable unit for contacting said cover means; and an unlock means coupled to said locking means for bringing said openable/closable unit from the closed position to the open position, said unlock means being accessible by an operator through the opening when said cover means is closably mounted on said cabinet, said cover means being openable in accordance with an opening movement of said openable/closable unit through said abutment means and said openable/closable unit being closable in accordance with a closing movement of said cover means through said abutment means, said cover means capable of being opened independent of said openable/closable unit.

* * * * *